US006508629B2

(12) United States Patent
Kerr, Jr.

(10) Patent No.: US 6,508,629 B2
(45) Date of Patent: Jan. 21, 2003

(54) CONNECTOR FOR ATTACHING A CEILING FAN BLADE TO A FAN BLADE HOLDER

(75) Inventor: Jack Russell Kerr, Jr., College Station, TX (US)

(73) Assignee: Angelo Fan Brace Licensing, L.L.C., Philadelphia, PA (US)

( * ) Notice: Subject to any disclaimer, the term of this patent is extended or adjusted under 35 U.S.C. 154(b) by 0 days.

(21) Appl. No.: 09/800,383

(22) Filed: Mar. 6, 2001

(65) Prior Publication Data

US 2002/0127106 A1 Sep. 12, 2002

(51) Int. Cl.[7] ..... F04D 29/34
(52) U.S. Cl. ..... 416/210 R; 416/244 R
(58) Field of Search ..... 416/210 R, 244 R, 416/5

(56) References Cited

U.S. PATENT DOCUMENTS 5,462,412 A * 10/1995 Scofield et al. ..... 416/210 R
5,486,094 A * 1/1996 Davis, Jr. et al. ..... 416/210 R
5,944,486 A * 8/1999 Hodgkins, Jr. ..... 416/210 R
6,010,306 A * 1/2000 Bucher et al. ..... 416/210 R
6,039,540 A * 3/2000 Wu ..... 416/210 R
6,241,476 B1 * 6/2001 Lee ..... 416/210 R
6,352,409 B1 * 3/2002 Blateri et al. ..... 416/207
6,371,729 B1 * 4/2002 Tseng ..... 416/210 R

* cited by examiner

*Primary Examiner*—Edward K. Look
*Assistant Examiner*—James M McAleenan
(74) *Attorney, Agent, or Firm*—Drinker Biddle & Reath LLP

(57) ABSTRACT

The present invention is directed toward a mechanical fastener for attaching a fan blade to a fan blade holder. The fan blade is attached to a fan blade holder by means of a spring clip. The spring clip engages a stud attached to the fan blade holder; the stud extends through an aperture in the fan blade. The invention may contain one or more studs or apertures, and the spring may have an arcuate shape in cross section.

Alternatively, the fan is held against the fan blade holder by means of a locking member. The locking member has spring clips attached to it in order to engage a stud extending from the fan blade holder through an aperture in the fan blade. This embodiment may contain one or more studs and locking clips. This embodiment may also contain a cover that slidably engages the locking member.

14 Claims, 4 Drawing Sheets

CONNECTOR FOR ATTACHING A CEILING FAN BLADE TO A FAN BLADE HOLDER

FIELD OF THE INVENTION

The present invention is generally related to mechanical connectors. More particularly, the present invention is related to mechanical connectors for attaching a fan blade to a fan blade holder.

SUMMARY OF THE INVENTION

The present invention is directed toward a mechanical fastener for attaching a fan blade to a fan blade holder. In the preferred embodiment of the invention, the fan blade is attached to a fan blade holder by means of a spring clip. The spring clip engages a stud attached to the fan blade holder; the stud extends through an aperture in the fan blade. This embodiment may contain one or more studs or apertures, and the spring may have an arcuate shape in cross section.

In an alternate embodiment, the fan is held against the fan blade holder by means of a locking member. The locking member has spring clips attached to it in order to engage a stud extending from the fan blade holder through an aperture in the fan blade. This embodiment may contain one or more studs and locking clips. This embodiment may also contain a cover that slidably engages the locking member.

BRIEF DESCRIPTION OF THE DRAWINGS

For the purposes of illustrating the invention, the drawings show a form of the invention that is presently preferred. However, it should be understood that this invention is not limited to the precise arrangements and instrumentalities shown in the drawings.

DETAILED DESCRIPTION OF THE DRAWINGS

Figure 2:
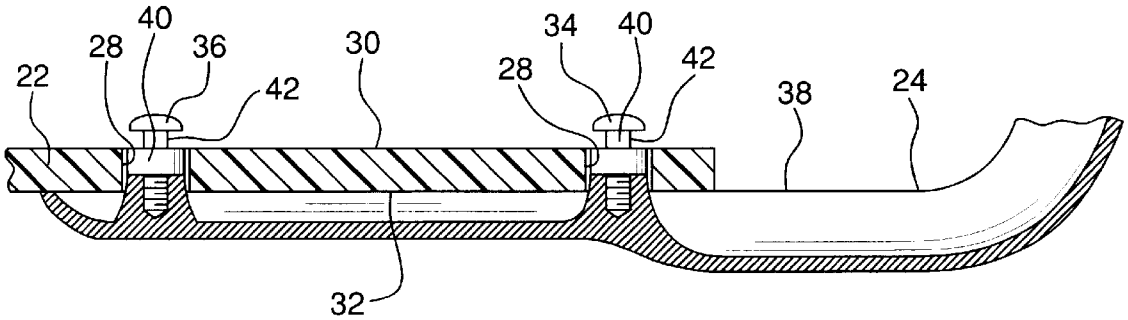
FIG. 2 is a cross sectional view of the fan blade and fan blade holder as taken along line 2—2 of FIG. 1.

Referring to the drawings, wherein like numerals indicate like elements, Figures land 2 illustrate a ceiling fan blade and fan blade holder assembly, which is designated generally by the numeral 20. The assembly comprises a fan blade 22, a blade holder 24 and a spring clip 26. The blade 22 is a typical fan blade having three apertures 28 and generally planar upper and lower surfaces 30,32. In a conventional ceiling fan installation, the three apertures 28 are used to attach the blade to a blade holder using threaded fasteners.

However, in an installation according to the present invention, the apertures 28 engage three studs 34, 36 on the blade holder 24 and the blade is retained on the blade holder by the spring clip 26. The blade 22 may be made of any material desired, such as wood, plastic or composites.

The blade holder 24 is generally Y-shaped and includes an upper surface 38 and the studs 34,36. Although the blade holder is shown as having a Y-shape, any suitable shape may be used. The studs 34, 36 are shown as threadedly engaging the blade holder 24. However, the studs may be formed integral with the blade holder or attached thereto by other means, such as welding. Each stud 34, 36 includes a standoff 40 that preferably extends beyond the upper surface 38 of the blade holder 24 by a distance approximately equal to the thickness of the blade 22. Each stud 34, 36 also includes an annular recess 42 that receives and engages the spring clip 26.

Figure 3:
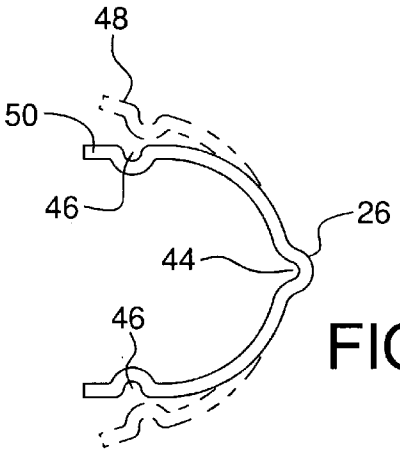
FIG. 3 is a plan view of the spring clip shown in FIG. 1.
Figure 4:
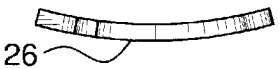
FIG. 4 side view of the spring clip shown in FIG. 1.
Figure 1:
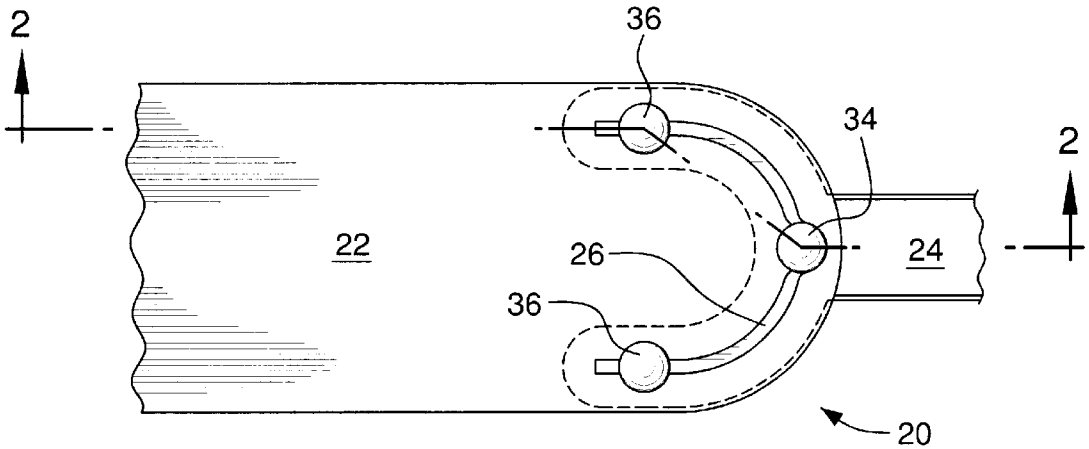
FIG. 1 is a partial plan view illustrating a fan blade and holder assembly utilizing a connector according to the present invention.
Figure 5:
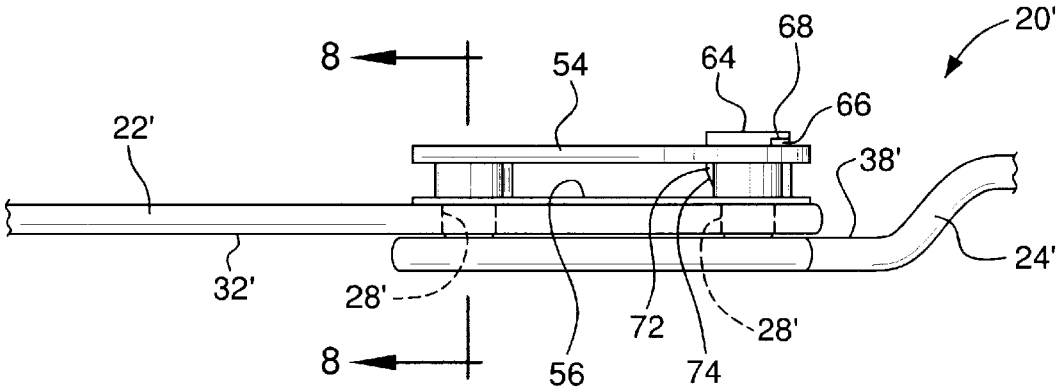
FIG. 5 is a partial side view illustrating a fan blade and holder assembly utilizing an alternative embodiment of a connector according to the present invention.
Figure 6:
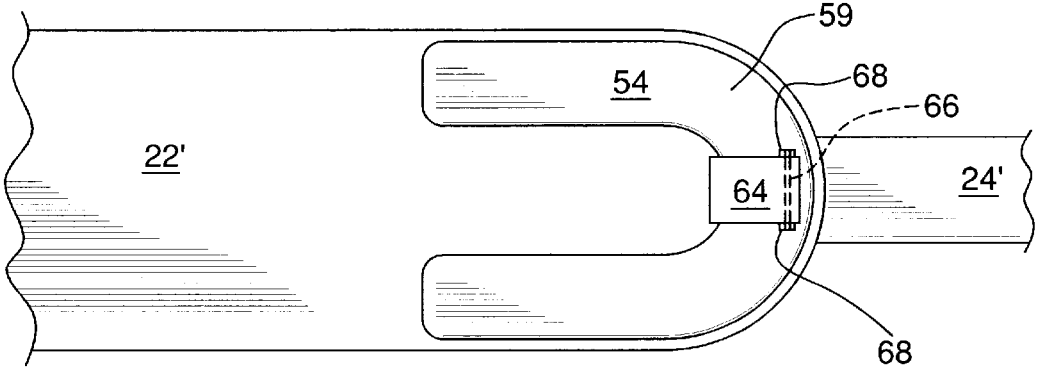
FIG. 6 is a plan view of the assembly shown in FIG. 5.
Figure 7:
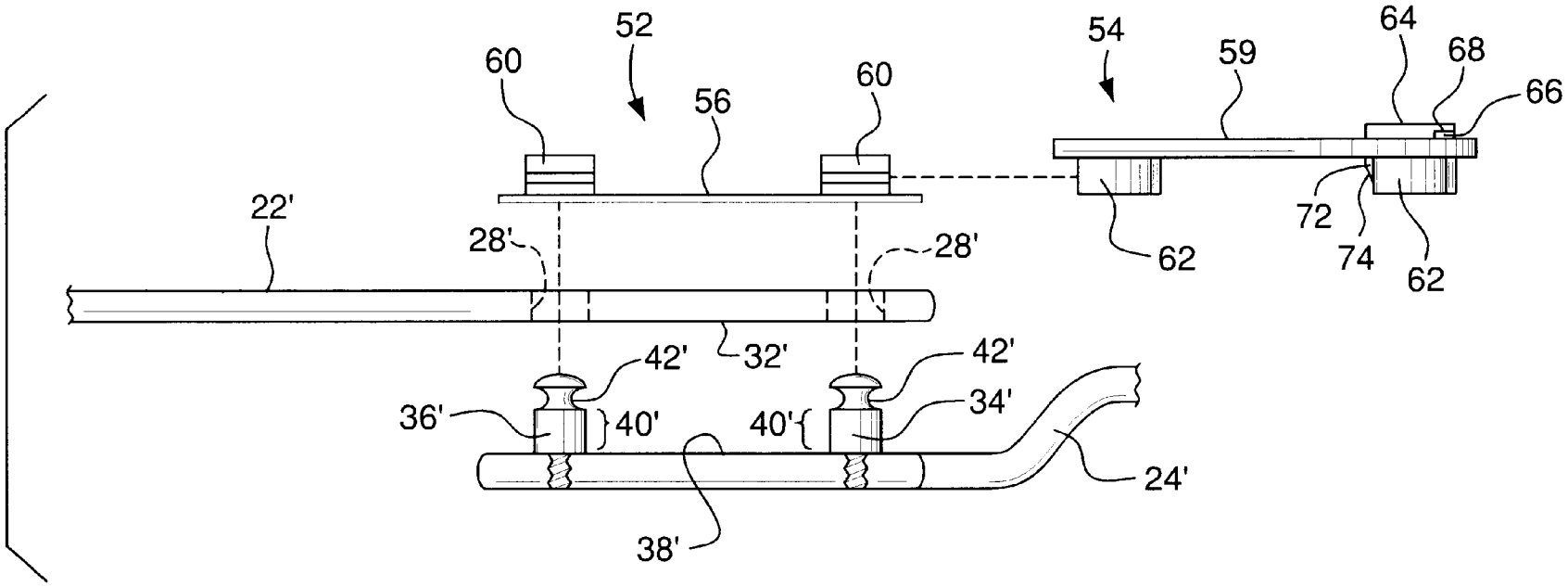
FIG. 7 is an exploded side view of the assembly shown in FIG.

Referring now to FIGS. 3 and 4, the spring clip 26 is a generally U-shaped member preferably made from spring steel or suitable high-strength resilient polymers. The spring clip 26 includes three generally semi-circular indentations 44, 46 that engage the three studs 34, 36 on the blade holder 24. For illustrative purposes, FIG. 4 shows the spring clip 26 in its unsprung shape 48 and a sprung shape 50. The unsprung shape 48 is the shape of the spring clip 26 in its relaxed state before being installed into the assembly 20. The sprung shape 50 is the shape that the spring clip 26 takes when installed.

As shown in FIG. 4, the spring clip 26 has a slight arcuate shape when viewed from the side. This shape allows the spring clip 26 to bias the blade 22 against the upper surface 38 of the blade holder 24 when the spring clip 26 is installed. This biasing tends to reduce movement of the blade 22 with respect to the holder 24. The arcuate shape also allows the spring clip 26 to be used with blades that are thinner than the height of the studs 34, 36 above the upper edge 38 of the blade holder 24.

To install the fan blade 22 onto the blade holder 24 using the spring clip 26 connector, the apertures 28 of the blade are engaged with the studs 34, 36 on the blade holder 24 and the lower surface 32 of the blade 22 is brought into contact with the upper surface 38 of the blade holder 24. The center indentation 44 is engaged with the center stud 34, and the free ends of the spring clip 26 are pressed toward one another and toward the upper surface 30 of the blade 22. With the free ends of the spring clip 26 held in contact with the upper surface 30 of the blade 22, the spring clip 26 is then partially relaxed to allow the lateral indentations 46 to engage the recesses 42 on the lateral studs 36.

FIGS. 5–10 show a fan blade and blade holder assembly 20' wherein the blade 22' is attached to the blade holder 24' using an alternative embodiment of a connector according to the present invention. Similar to the embodiment of FIGS. 1–4, the blade holder 24' of the embodiment in FIGS. 5–10 includes an upper surface 38' and studs 34' 36', each of which has an annular recess 42' and a standoff 40'. In place of the spring clip 26 of the embodiment of FIGS. 1–4, however, the embodiment of FIGS. 5–10 utilizes a locking member 52 to retain the blade 22' on the blade holder 24'. A cover 54 is provided as a decorative element to hide a portion of the locking member 52 and studs 34', 36' from view. In addition, the cover protects the studs 34', 36' from airborne contaminants and shields a handler from any sharp edges on the locking member 52 after installation.

Figure 8:
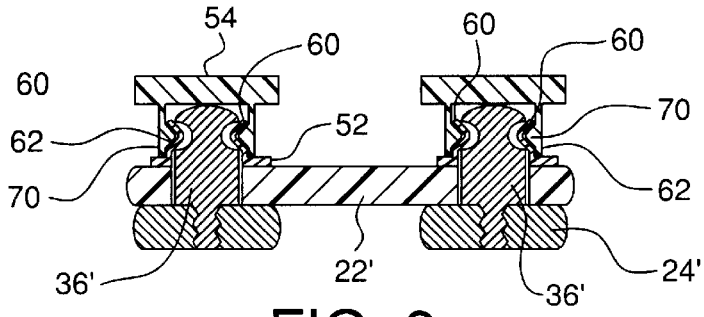
FIG. 8 is a cross-sectional view of the assembly as taken along line 8—8 of FIG. 5.
Figure 9:
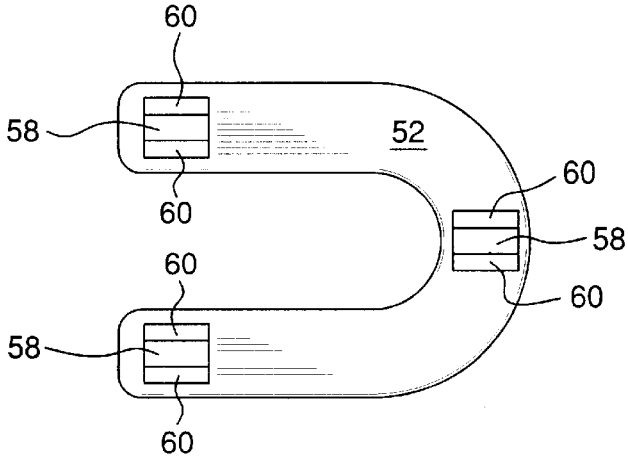
FIG. 9 is a view of the underside of the locking clip shown in FIG. 5.
Figure 10:
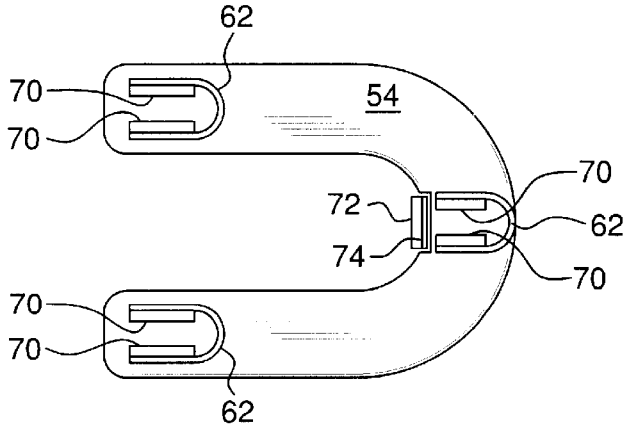
FIG. 10 is a view of the underside of the locking clip cover shown in FIG. 5.

The locking member 52 includes a generally U-shaped planar base 56 having three rectangular apertures 58. A pair of locking clips 60 flanks each aperture 58 and engage a corresponding one of the studs 34', 36' on the blade holder 24'. As best illustrated in FIG. 8, each locking clip 60 generally forms a V shape. In each pair of corresponding locking clips 60, the vertices of the V shape point toward one another. When the locking clips 60 are relaxed, the distance between the vertices of each corresponding pair of locking clips 60 is less that the diameter of the corresponding stud 34', 36' at its recess 42'. Thus, when the locking member 52 is engaged with the studs 34', 36', the locking clips 60 of each pair are biased toward one another, providing a snap fit with the corresponding recess 42'. The locking member 52 is preferably made of a 1/16 inch thick plate of spring steel.

The cover 54 includes a planar U-shaped base 59, three U-shaped retainers 62 and a stop 64. The base 59, retainers 62 and stop 64 are preferably, though not necessarily, made of plastic. Moreover, the base 59 and retainers 62 are preferably formed integrally with one another. The stop 64 is pivotably attached to the base 59 with a pivot pin 66 that engages a pair of gussets 68 flanking the stop 64. Each retainer 62 slidably engages a corresponding one of the pairs of locking clips 60. A generally V-shaped ridge 70 on opposing walls of each retainer 62 matingly engages the channel formed in the corresponding spring clip 60. The stop 62 includes a downwardly-projecting tab 72 that prevents the locking member 52 from inadvertently disengaging the studs 34', 36' and the cover 54 from inadvertently disengaging the locking member 52. The tab 72 includes an beveled surface 74 that allows the tab 72 to pivot upward when it is pushed against the central pair of locking clips 60 as the cover 54 is being installed.

To install the fan blade 22' using the alternative connector embodiment shown in FIGS. 5–10, the blade 22' is engaged with the holder 24' such that the studs 34', 36' extend through the apertures 28' and the lower surface 32' of the blade 22' contacts the upper surface 38 of the holder 24'. The locking member 52 is then installed by pushing down on it until the locking clips 60 snap fit into the annular recesses 42' in the corresponding studs 34' 36'. The cover 54 is then slidably engaged with the locking member 52 until the tab 72 on the stop 64 contacts the proximal end of the central locking clips 60, rides up and over the clips 60 and stud 34' and falls into position adjacent the distal end of the spring clips 60. To remove the cover 54, the tab 72 is pivoted upward, allowing the cover 54 to slidably disengage the locking member 52.

Although the invention has been described and shown with respect to the exemplary embodiment thereof, it should be understood by those skilled in the art that the foregoing and various other changes, omissions and additions may be made therein and thereto, without parting from the spirit and scope of the present invention.

I claim:

1. A fan blade assembly comprising:

a) a fan blade holder for holding a fan blade, the fan blade holder having at least one stud extending therefrom, wherein the stud includes an annular recess;

b) a fan blade for mounting on the fan blade holder, the fan blade having at least one aperture for receiving the stud;

c) a spring clip having an arcuately shaped cross-section for engaging the at least one stud and the fan blade, the spring clip holding the fan blade against the fan blade holder;

d) wherein the spring clip includes indentations for engaging the annular recess; and e) wherein the spring clip must be compressed by pressing the indentations toward each other prior to engaging the studs.

2. The fan blade assembly of claim 1, wherein the number of studs is two and the number of apertures is two.

3. The fan blade assembly of claim 1, wherein the number of studs is three and the number of apertures is three.

4. The fan blade assembly of claim 1, wherein the at least one stud has a standoff that is in the plane of a planar upper surface of the fan blade.

5. A spring clip for mounting a fan blade on a fan blade holder with studs having annular recesses, the spring clip comprising:

indentations for engaging the fan blade holder;

wherein the spring clip has an arcuately shaped cross-section;

wherein the spring clip engages the fan blade and the spring clip holds the fan blade against the fan blade holder;

wherein the spring clip includes indentations for engaging the annular recess; and wherein the spring clip must be compressed by pressing the indentations toward each other prior to engaging the studs.

6. A fan blade assembly comprising:

a) a fan blade holder for holding a fan blade, the fan blade holder having at least one stud extending therefrom;

b) a fan blade for mounting on the fan blade holder, the fan blade having at least one aperture for receiving the stud;

c) a locking member for engaging the at least one stud and the fan blade, the locking member holding the fan blade against the fan blade holder, wherein the locking member is U shaped and has a cover.

7. The fan blade assembly of claim 1, wherein the at least one stud has includes an annular recess;

and wherein the locking member includes a locking clip for engaging the annular recess.

8. The fan blade assembly of claim 7, wherein the locking clip has two vertices, and each vertex has a generally V shaped cross section, the vertices of the locking clip engage the annular recess of the stud, securing the fan blade against the fan blade holder.

9. The fan blade assembly of claim 6, further comprising:

a) a U shaped cover for slidably engaging the locking member.

10. The fan blade assembly of claim 6, further comprising:

a) said cover for slidably engaging the locking member, the cover having ridges for engaging the locking clip.

11. A fan blade assembly comprising:

a) a fan blade holder for holding a fan blade, the fan blade holder having at least one stud extending therefrom;

b) a fan blade for mounting on the fan blade holder, the fan blade having at least one aperture for receiving the stud;

c) a locking member for engaging the at least one stud and the fan blade, the locking member holding the fan blade against the fan blade holder; and d) a cover for slidably engaging the locking member.

12. A fan blade assembly comprising:

a) a fan blade holder for holding a fan blade, the fan blade holder having at least one stud extending therefrom;

b) a fan blade for mounting on the fan blade holder, the fan blade having at least one aperture for receiving the stud; and c) a means for engaging at least one stud of and the fan blade, thereby securing the fan blade against the fan blade holder.

13. A fan blade assembly comprising:

a) a fan blade holder for holding a fan blade, the fan blade holder having at least one stud extending therefrom, the stud having an annular recess thereon;

b) a fan blade for mounting on the fan blade holder, the fan blade having at least one aperture for receiving the stud;

c) a locking member for engaging the at least one stud and the fan blade, the locking member holding the fan blade against the fan blade holder;

d) wherein the locking member has two vertices, and each vertex has a generally V shaped cross section, the vertices of the locking member engage the annular recess of the stud, securing the fan blade against the fan blade holder; and e) a cover for slidably engaging the locking member, the cover having ridges for engaging the vertices of the locking clip.

14. The fan blade assembly of claim 13 wherein the cover has a stop with a projecting tab, the tab preventing the locking member from disengaging the studs.

* * * * *